United States Patent [19]

Gist

[11] 4,304,429

[45] Dec. 8, 1981

[54] LOCKING APPARATUS FOR SLIDING WINDOWS AND THE LIKE

[76] Inventor: Marion A. Gist, Rte. 1, Box 110, Bandon, Oreg. 97411

[21] Appl. No.: 116,101

[22] Filed: Jan. 28, 1980

[51] Int. Cl.[3] ..... E05C 19/18

[52] U.S. Cl. ..... 292/258; 292/257; 292/DIG. 46; 292/DIG. 7

[58] Field of Search ..... 292/257, 258, DIG. 7, 292/DIG. 46, 288

[56] References Cited

U.S. PATENT DOCUMENTS

| | | | |
|---|---|---|---|
| 1,326,608 | 12/1919 | Nippert | 292/258 |
| 1,367,739 | 2/1921 | Hibbard | 292/258 |
| 1,799,464 | 4/1931 | Hiser | 292/257 X |
| 1,934,036 | 11/1933 | Canedy | 292/257 X |
| 2,665,430 | 1/1954 | Ross et al. | 292/257 X |
| 3,756,641 | 9/1973 | Dugan | 292/258 |
| 4,062,576 | 12/1977 | Jennings et al. | 292/258 |

*Primary Examiner*—Richard E. Moore
*Attorney, Agent, or Firm*—Francis X. LoJacono

[57] ABSTRACT

A locking apparatus for sliding metal casement windows, doors and the like, the apparatus being adapted to be lockably secured within the lower or upper track portion of the window casement so as to prevent the slidable window from being laterally or vertically moved therein, the locking apparatus comprising a body member having a substantially rectangular configuration defined by front and rear walls, and top and bottom wall members, a longitudinal opening being provided between the front wall and the bottom wall, and the opening being arranged to receive the outer track wall of the casement, whereby the outer track wall is clamped between the front wall and a locking cam member which is rotatably mounted between the top and bottom walls of the body member, the cam including an eccentrically positioned shaft adapted to receive a knob for locking and unlocking the apparatus.

2 Claims, 6 Drawing Figures

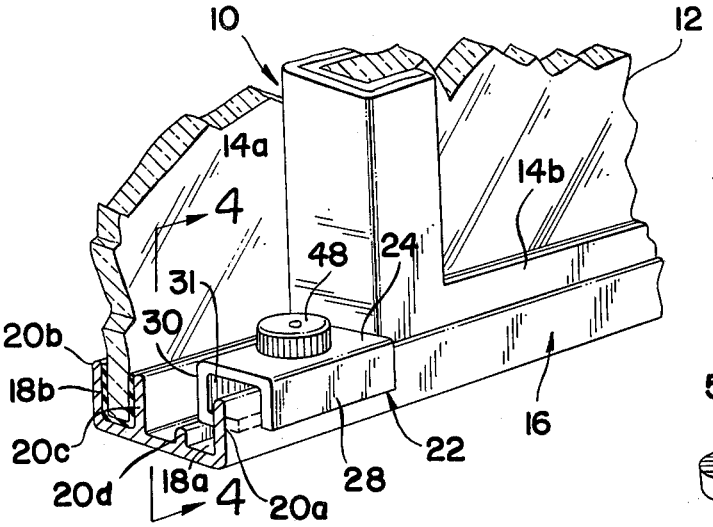
FIG. 1
FIG. 6
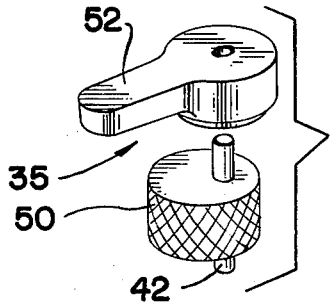
FIG. 2
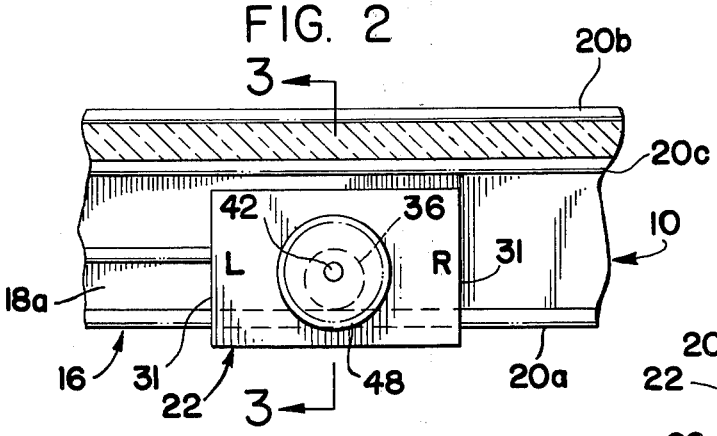
FIG. 3
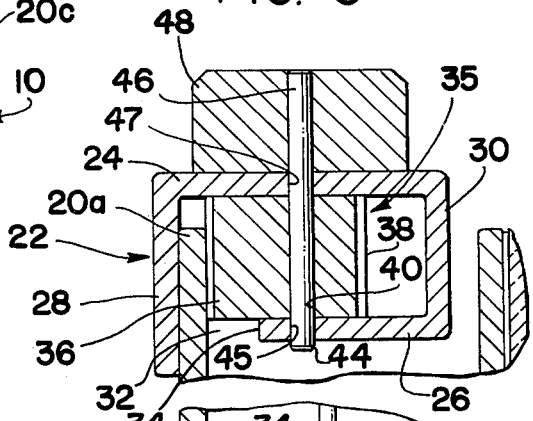
FIG. 4
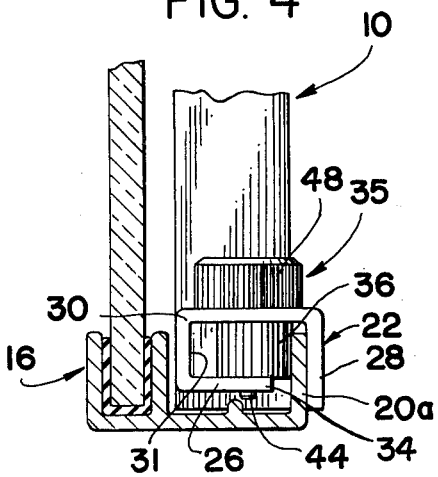
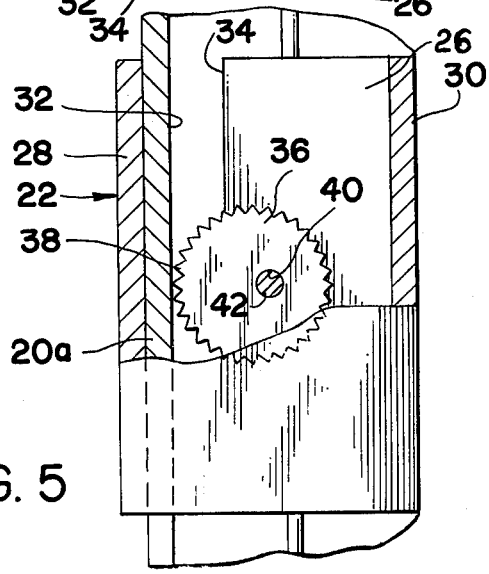
FIG. 5

LOCKING APPARATUS FOR SLIDING WINDOWS AND THE LIKE

BACKGROUND OF THE INVENTION

1. Field of the Invention

This invention relates generally to locking devices, and is more particularly directed to a removable locking apparatus for use in preventing or limiting the sliding movement of a metal type window or the like.

2. Description of the Prior Art

It is well known in the art that many problems and difficulties are encountered in providing suitable means for limiting and/or preventing the lateral sliding movement of panels and closures, especially with sliding metal casement windows where each window is movably supported within channel-like frame sections which form a generally rectangular casement frame structure wherein the upper and lower frame sections are formed as tracks to slidably receive the window section therein.

Several types of locking devices have been tried but with limited success, due to various inherent problems of the particular arrangement of each specific locking device.

For example, U.S. Pat. No. 3,428,349 discloses a channel-shaped body member which is mountable on a window or door-guide flange in position to be engaged by the closure, the channel-shaped body being secured to the flange by a thumb screw mounted on one of the body flanges. Thus, if one does not provide enough strength to turn the thumb screw in a very tight bind against the window-guide flange, the window can be moved against the channel body with a force to overcome the binding force applied by the thumb screw. Thus, one would need an additional tool to turn the thumb screw for a positive locking engagement.

In U.S. Pat. No. 3,415,560 there is disclosed a locking device comprising a housing defining a passage having a ball disposed in the passage. When the device is installed, a spring urges the ball towards a surface of the window structure; and thus the ball becomes wedged in the passage against the window structure. However, if the window is slightly ajar, leverage can be applied directly or intermittently, causing the ball to slip within the passage.

A further example is disclosed in U.S. Pat. No. 3,975,041 which provides a clamping-wedge member for wedging against the corner of the sliding panel.

Another type of lock for sliding windows and doors is disclosed in U.S. Pat. No. 3,490,802 which provides a stop block having a lock pin extending from the block to engage a sliding panel.

SUMMARY OF THE INVENTION

The invention herein disclosed provides an apparatus to prevent or limit the lateral or vertical sliding movement of a closure or panel, such as a sliding metal casement or door.

The present apparatus comprises a frame housing defined by a top, a bottom, and front and rear walls having open ends and an elongated opening or slot disposed between the front wall and the free edge of the bottom wall. Rotatably supported within the housing is a locking-cam member which is provided with an eccentrically positioned shaft journaled in the top and bottom walls of the housing. Accordingly, the outer flange wall of the metal casement structure is readily received in the housing through the slot, and is directly engaged by the locking-cam member which is rotated to a locking-cam position by a knob, the cam surface of the cam member being provided with annularly projecting teeth or knurls.

OBJECTS AND ADVANTAGES OF THE INVENTION

The present invention has for an object to provide a new and improved locking apparatus for preventing or limiting the lateral movement of closures or sliding panels, particularly sliding metal casement windows.

Another object of the invention is to provide a locking apparatus for slidable metal windows and doors which is not readily accessible from the outside of the building, and which is substantially burglar-resistant.

A further object of the present invention is to provide a sliding-window lock which embodies a cam-locking member that binds in a positive locking mode, when force is applied to the associated window against the cam action thereof.

A still further object of the invention is to provide a locking device of this character that can be easily secured or removed manually, without the aid of special tools; and that can perform its locking function without modification to the metal window structure of sliding panel, and can be easily installed by persons having few mechanical skills.

It is still a further object of the invention to provide a device of this character that can be used on both right-hand and left-hand opening closures and slidable panels.

A still further object is to provide a locking apparatus of the character described that is also capable of limiting the width that a metal window can be moved to a selected open position.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any metal structures, arrangements or modes of operation that are properly within the scope of the appended claims.

BRIEF DESCRIPTION OF THE DRAWINGS

Referring more particularly to the accompanying drawings, which are for illustrative purposes only:

FIG. 1 is a pictorial view of the present invention mounted on a portion of a metal frame structure positioned adjacent a slidable metal window;

FIG. 2 is a top-plan view of the locking apparatus attached to the frame structure of the metal window casement;

FIG. 3 is an enlarged cross-sectional view of the locking device taken substantially along line 3—3 of FIG. 2;

FIG. 4 is an end view as seen along line 4—4 of FIG. 1;

FIG. 5 is an enlarged top-plan view of the locking device with a portion broken away to show the locking-cam member in direct engagement with one flange wall of the metal casement frame; and FIG. 6 is an exploded view of an alternative arrangement of a knob to rotate the cam member.

DESCRIPTION OF THE PREFERRED EMBODIMENT

Referring more particularly to FIG. 1, there is shown a closure or panel defined by a slidable metal window, generally indicated at 10. It should be understood that the present invention may be used with various types of slidable metal closures or panels; but it is herein shown and described in association with a slidable metal window 10 of conventional structure which includes a window panel 12 having a metal window frame structure 14, wherein the leading vertical frame 14*a* and the lower longitudinal frame member 14*b* are parts thereof.

As generally established in the art, window 10 is slidably mounted within a metal casement structure having four structural frame members, only the lower member 16 being shown.

Casement-frame member 16 comprises at least two parallel contiguous metal channels 18*a* and 18*b* formed by oppositely disposed flange walls 20*a* and 20*b*, and a central intermediate wall 20*c*. It will be noted that the window 10 is slidably disposed in channel 18*a* which also defines a track in which window 10 slides, and further includes a central rail member 20*d*. However, various other track arrangements are known in the art and are adapted to receive the present invention as herein shown.

Thus, the present invention comprises a locking apparatus, indicated generally at 22, which is adjustably mounted along flange wall 20*a* of frame 16. Locking device 22 provides a means to locate the window 10 at a selective position along track 18*a*, wherein window 10 can be locked fully closed or locked in a slightly open position to allow air to pass through—but prevent access to the lock from the outside or further movement of the window 10.

Locking device 22 comprises a main housing having a substantially rectangular configuration defined by a top wall 24, a bottom wall 26, and front and rear walls 28 and 30, respectively. Accordingly, the arrangement of the walls 24, 26, 28 and 30 forms a substantially rectangular tube-shaped housing having open opposite ends 31, an elongated slot 32 being provided between the lower edge of the front wall 28 and the adjacent longitudinal edge 34 of the bottom wall 26. The slot thus extends the full length of the housing from one open end 31 to the other, thereby allowing the locking device to be positioned within channel 18*a*, as seen in FIG. 2. That is, flange wall 20*a* of frame section 16 is received within longitudinal slot 32.

In order to lock the housing in a selective position, there is included a cam means, generally indicated at 35, centrally disposed within the housing and adapted to lockingly engage flange wall 20*a* of frame section 16. The cam means comprises a circular cam-bar member 36, a plurality of vertical teeth members 38 (defining a vertical knurl arrangement) being formed on the outer peripheral cam surface. Cam bar 36 includes a bore 40 which is eccentrically disposed therethrough and in which a shaft 42 is fixedly located. Shaft 42 extends above and below the cam bar 36, the lower shaft extension 44 being adapted to be rotatably received in hole 45 formed in bottom wall 26, and the upper shaft extension 46 being adapted to be rotatably received in hole 47 in top wall 24 and further extend upwardly to accept a knob 48 which is affixed to shaft extension 46.

At this point, it should be noted that the cam surface can also be provided with other suitable locking surfaces such as the conventional diamond-shaped knurl 50, shown in FIG. 6. Further, other suitable devices can be used in place of a knob, such as handle 52 in FIG. 6.

Accordingly, cam bar 36 is positioned to allow flange member 20*a* to be received in slot 32 and interposed between front wall 28 of housing 16 and the knurled surface of cam bar 36.

If the slidable metal window 10 is positioned to the right of the locking device 22 as shown in FIGS. 1 and 2, the window would open to the left and then knob 48 is rotated to the left as indicated by arrow mark "L". Thus, any force applied to window 16 in an opening direction will force the cam member to engage flange 20*a* in a binding engagement.

When window 10 is positioned to the left of lock 22, knob 48 is rotated to the right as indicated by arrow mark "R". The arrangement of the cam bar thus allows the lock to be employed with the same degree of positive locking response. In order to unlock, a very simple turn of knob 48 will disengage the cam bar surface whereby lock 22 can be readily removed or repositioned in the track.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A locking apparatus for sliding metal casement windows, doors and the like, wherein said apparatus is adapted to be lockably secured within the lower or upper track portion of a metal window casement to prevent said window from being laterally or vertically moved therein, said apparatus comprising a tube-shaped body member having a substantially rectangular configuration defined by front, rear, top and bottom walls, and having open opposite ends, wherein a longitudinal slot is provided between said front wall and said bottom walls, said slot being arranged to receive the outer flange wall of said track, and wherein said flange wall is clamped between said front wall and a locking cam-bar member rotatably mounted between said top and bottom walls thereby positioning said cam for within said track, said cam-bar member including an eccentrically disposed shaft adapted to receive a knob member for rotatably positioning said cam bar in a locked or unlocked position.

2. A locking apparatus as recited in claim 1, wherein said cam-bar member includes a knurled cam surface for locking engagement with said flange member.

* * * * *